US005472398A

United States Patent [19]

Silverman

[11] Patent Number: 5,472,398

[45] Date of Patent: Dec. 5, 1995

[54] ATHLETIC HARNESS FOR FRONT SQUATS

[76] Inventor: Steven B. Silverman, 7 Easton Ave., Swampscott, Mass. 01907

[21] Appl. No.: 430,837

[22] Filed: Apr. 28, 1995

Related U.S. Application Data

[63] Continuation-in-part of Ser. No. 388,245, Feb. 14, 1995.

[51] Int. Cl.[6] ..... A63B 21/12

[52] U.S. Cl. ..... 482/105; 482/148; 482/106

[58] Field of Search ..... 482/105, 106, 482/10, 69, 93, 148, 139; 224/265, 266

[56] References Cited

U.S. PATENT DOCUMENTS

| | | | |
|---|---|---|---|
| 2,746,369 | 5/1956 | Beard et al. | 224/265 |
| 3,307,850 | 2/1968 | Moore | 272/84 |
| 3,322,425 | 5/1967 | Moore | 482/105 |
| 3,679,107 | 7/1972 | Perrine | 224/5 P |
| 3,724,846 | 4/1973 | Perrine | 272/84 |
| 4,213,605 | 7/1980 | McPeak | 272/119 |
| 4,722,524 | 2/1988 | Waszkelewicz | 272/123 |
| 4,986,536 | 1/1991 | Zane | 482/105 |
| 5,118,100 | 6/1992 | Sungaila | 482/105 |
| 5,167,600 | 12/1992 | Baird | 482/105 |
| 5,211,615 | 5/1993 | Sides | 482/105 |

OTHER PUBLICATIONS

Moore's Leg Blaster—"Iron Man" Magazine May 1985 vol. 44, No. 4.

*Primary Examiner*—Stephen R. Crow

*Attorney, Agent, or Firm*—Morse, Altman, Dacey & Benson

[57] ABSTRACT

The present invention is an athletic harness for enhancing thoracic freedom while supporting a barbell during front squat exercises, said harness comprising a pair of rigid, over-the-shoulder, inverted "J"-shaped braces for maintaining the dimensional stability of the harness during said front squat exercises, where the braces include extended anterior portions, posterior portions that engage the shoulders rearwardly, and yoke portions that engage the shoulders supportively; a means for securing the lower extremities of the anterior portions together; a means for supporting the abdomen during said exercises; a pair of pins projecting forwardly from the anterior portions, where the pins are adapted to carry the bar of the barbell during the front squat exercises; and a means for preventing splaying of the braces during the front squat exercises.

18 Claims, 4 Drawing Sheets

ATHLETIC HARNESS FOR FRONT SQUATS

RELATED APPLICATION

The present application is a continuation-in-part application of application Ser. No. 08/388,245, dated Feb. 14, 1995 for ATHLETIC HARNESS FOR ENHANCING SQUATS DURING WEIGHTLIFTING in the name of inventor Steven B. Silverman.

BACKGROUND OF THE INVENTION

1. Field of the Invention

This invention relates to exercise apparatus, and more particularly, to an athletic harness that properly supports a weightlifting bar at the shoulders during free weight front squats.

2. The Prior Art

A free weight squat requires that the bar on which weight plates are mounted be positioned across the individual's shoulders in front of or behind the neck. In the absence of an appropriate apparatus, an individual uses his or her hands to hold the bar in place. In this situation, the bar is susceptible to slipping out of position, for example, because of possible physical limitations of the individual, combined with the fact that the shoulders do not provide an adequate horizontal or depressed surface on which to rest the bar. As a result, there may be a need to limit the weight of the bar to preclude slippage. This makes it difficult for an individual doing squat exercises to reach his or her full potential.

Also, an emergency may occur requiring the individual to drop or "dump" the bar. In the absence of an appropriate apparatus, the individual would try to push the bar away from his or her body and then release it, allowing it to fall to the floor. Depending on the nature of the emergency, this may be difficult to do and cause further injury. For example, if the individual has lost his or her balance and is falling backwards, the bar may simply roll or slide down the front of the individual's body, possibly causing substantial injury.

The typical prior art apparatus for performing free weight squats is a device that is positioned on the shoulders of the individual. The bar is then positioned in slots or notches, located in front of or behind the neck, that keep the bar from sliding down the front or back of the individual's body. The apparatus typically is kept in place by handles that the individual grasps or by straps that wrap around the individual's torso. The need to hold the apparatus handles leaves the bar susceptible to sliding or falling to the side due to a lack of proper balance and control of the bar. The need to tightly bind the straps around the torso so that the apparatus does not slip out of place from the weight of the plate-loaded bar makes it difficult to breath properly when doing squat exercises.

Furthermore, notches and slots do not permit easy dumping of the bar if the individual feels a need to do so. With an apparatus that has handles, the individual's hands must control the apparatus rather than the bar, so that the ability to control a dump of the bar is decreased dramatically. With an apparatus that has straps, the straps must be wrapped tightly around the torso, making it more difficult to bend in order to dump the bar.

Thus, there continues to be a need for an apparatus that combines the abilities to properly locate a weight plate-loaded bar, to adequately control the bar, and to breath correctly so that an individual can realize his or her full potential in the free weight squat exercise.

SUMMARY OF THE INVENTION

The athletic harness of the present invention overcomes various disadvantages inherent in the prior art. The preferred embodiment of the athletic harness comprises a pair of rigid, over-the-shoulder, inverted "J"-shaped braces for maintaining the dimensional stability of the harness, a crossbar at the base of the braces connecting the braces together, an abdominal support attached to the back of the crossbar, a pair of pins projecting from the front of the braces that are adapted to carry the bar of a barbell, a cushion attached to the inner surface of each of the braces for resilient abutment against the shoulders and chest, a cushion attached to the inner surface of the abdominal support for resilient abutment against the abdomen, and a tie connected between the braces for preventing splaying of the braces during exercising.

The braces provide a mechanism for distributing the weight of the bar more evenly over the shoulders. Each brace has an extended anterior portion, a yoke portion, and a posterior portion. The cushions on the inner surface of the braces maintain the comfort of the shoulders and chest during the exercise. The crossbar connects the braces together at the end of the anterior portions in a manner that allows the braces to be rotated relative to each other for adapting to different sized individuals and for storage and shipping. The abdominal support is attached to the back of the crossbar in a manner that allows it to move vertically and to rotate with respect to the crossbar in order to adapt to different sized individuals and for storage and shipping. The abdominal support provides support for maintaining the proper position of the harness. The cushion on the inner surface of the abdominal support maintains the comfort of the abdomen during the exercise. The extended anterior portion of the braces and the abdominal support eliminates the need for handles on the harness or straps around the torso and allows the individual the freedom to more completely control the bar itself and to breath correctly while doing free weight front squats.

The pins projecting from the front of the braces are positioned at an angle such that the bar rests between the upper surface of the pins and the outer surface of the braces, and such that only a small forward lean and slight push by the hands is needed to dump the bar. With the individual's hands on the bar controlling it, the dump can be controlled.

The tie connects across the anterior portions to prevent the braces from spreading out down the individual's shoulders due to the weight of the bar. The tie is adjustable to allow adaptation to individuals of different sizes.

Thus, the weightlifting apparatus of the present invention affords an individual a stable support platform for a bar while doing free weight front squat exercises; permits direct control by the individual over the bar for balancing and dumping; permits proper breathing while in use; and that is generally comfortable to wear during use.

Other objects of the present invention will in part be obvious and will in part appear hereinafter.

BRIEF DESCRIPTION OF THE DRAWINGS

For a fuller understanding of the nature and object of the present invention, reference is made to the accompanying drawings, wherein.

DETAILED DESCRIPTION OF THE PREFERRED EMBODIMENT

Figure 1:
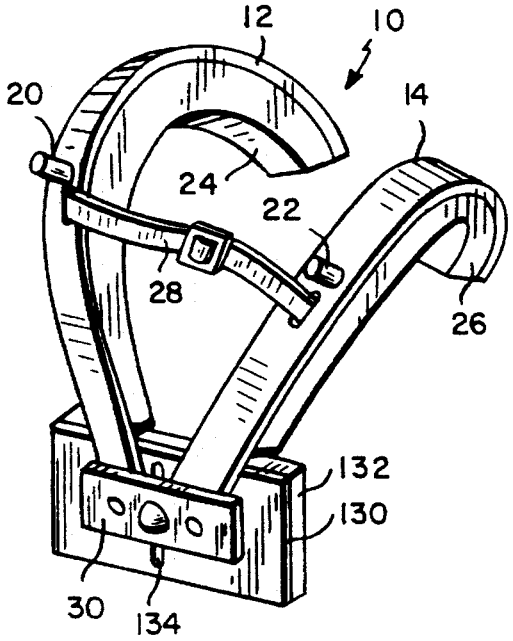
FIG. 1 is a view in relief of the present invention.
Figure 2:
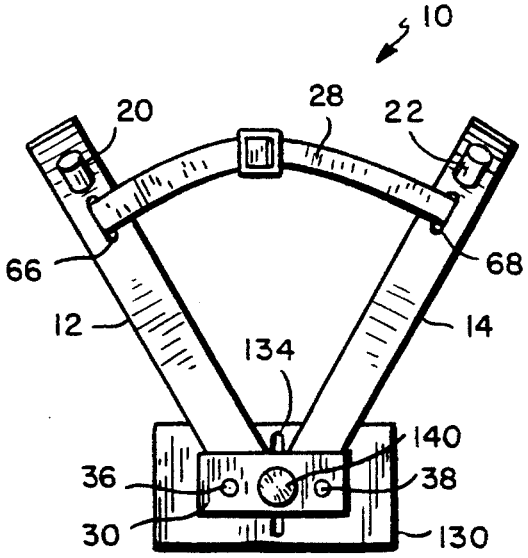
FIG. 2 is a front elevational view of the present invention of FIG. 1.
Figure 3:
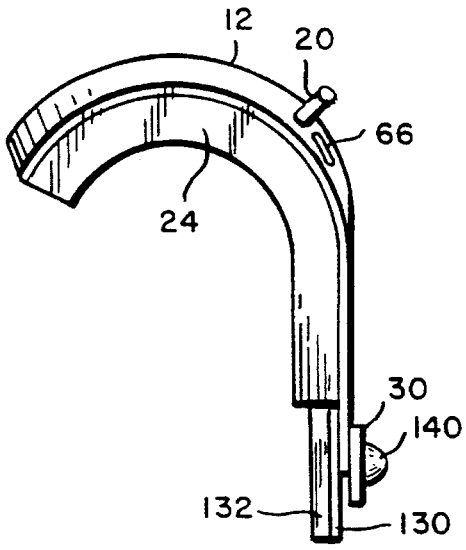
FIG. 3 is a right profile of the present invention of FIG. 1.
Figure 4:
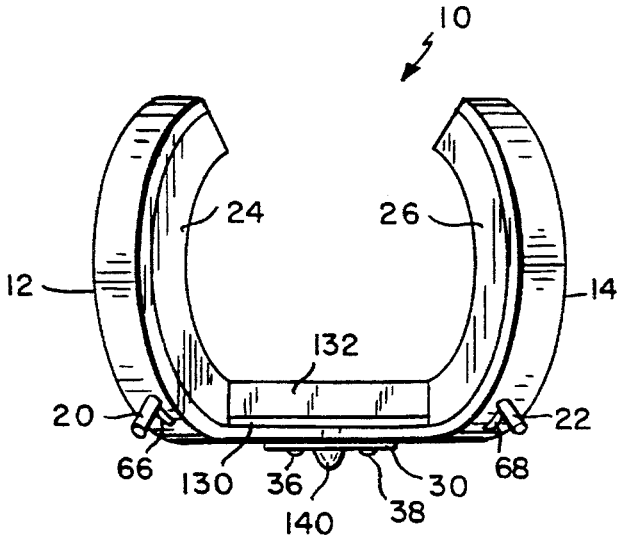
FIG. 4 is a top view of the present invention of FIG. 1.

FIGS. 1 to 4 show the preferred embodiment of the present invention 10. The athletic harness comprises a pair of rigid braces 12, 14, a crossbar 30 at the base of the braces 12, 14, an abdominal support 130 at the rear of the crossbar 30, a pin 20, 22 projecting from each of the braces 12, 14, a cushion 24, 26 attached to the inner surface of each of the braces 12, 14, a cushion 132 attached to the inner surface of the abdominal support 130, and a tie 28 between the braces 12, 14.

Figure 5:
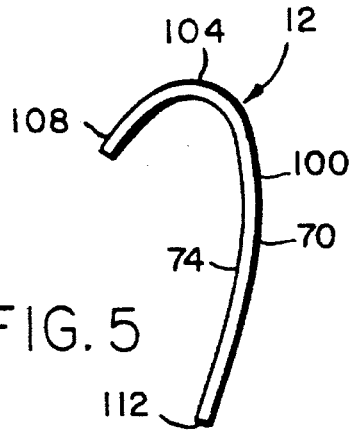
FIG. 5 is a right profile of the right brace.
Figure 6:
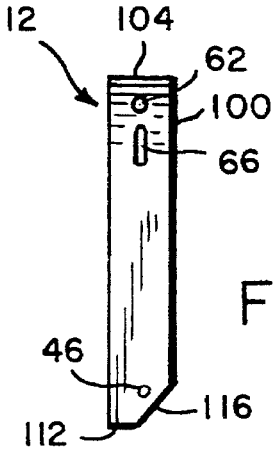
FIG. 6 is a front elevational view of the right brace of FIG. 5.
Figure 7:
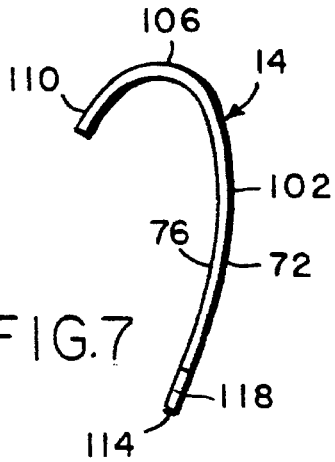
FIG. 7 is a right profile of the left brace.
Figure 8:
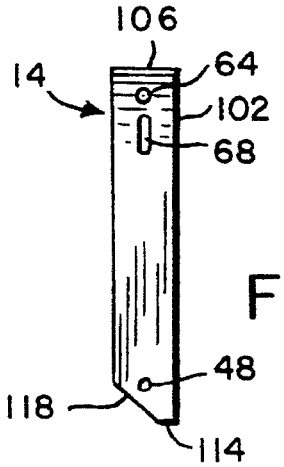
FIG. 8 is a front elevational view of the left brace of FIG. 7.

Both braces 12, 14 have the substantially identical shape, that of an inverted "J" and are adapted to fit over a shoulder and down the chest. FIGS. 5 and 6 show a right profile and front elevation of the right brace 12 and FIGS. 7 and 8 show a right profile and front elevation of the left brace 14. The both braces 12, 14 have an extended anterior portion 100, 102, a yoke portion 104, 106, and a posterior portion 108, 110. Preferably, the braces 12, 14 are composed of ⅜-inch cold rolled steel and are about 2 inches wide.

There is a hole 46, 48 through the braces 12, 14 near the anterior end 112, 114 used for securing the braces 12, 14 to the crossbar 30, as described below. The hole 46, 48 is approximately ⅜ inch in diameter.

The anterior end 112, 114 has a diagonal edge 116, 118, the right brace 12 having the diagonal 116 on the left side and the left brace having the diagonal 118 on the right side. The purpose of the edge 116, 118 is to prevent the braces 12, 14 from interfering with each other when they are rotated into and out of their storage positions. The storage of the harness 10 is discussed later.

There is a round pin hole 62, 64 in the upper end of the anterior portion 100, 102 for mounting the pin 20, 22. The pin hole 62, 64 about ¾ inch in diameter.

There is a slot 66, 68 in upper end of the anterior portion 100, 102 below the pin hole 62, 64 for securing the tie 28. The slot 66, 68 is oriented with its long axis parallel to the long dimension of the brace. In an alternate embodiment, the slot is located in the upper end of the posterior portion 108, 110.

Figure 9:
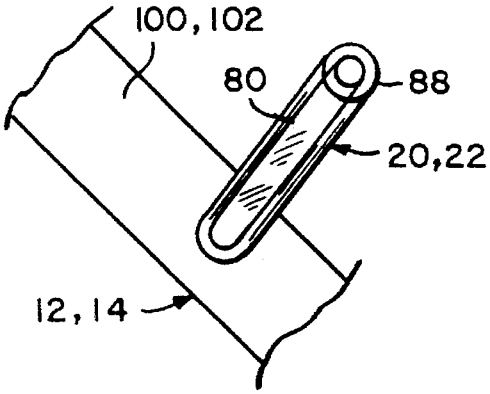
FIG. 9 is an enlarged view in relief of a mounted pin.
Figure 10:
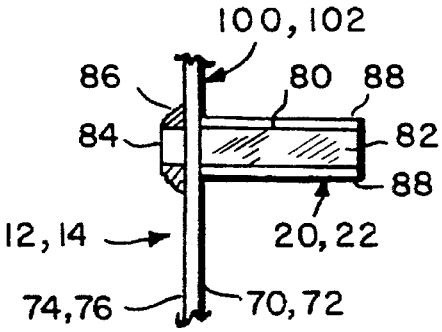
FIG. 10 is a profile of the mounted pin of FIG. 9.

As shown in FIGS. 9 and 10, there is a pin 20, 22 bonded to the outer surface of the anterior portion 70, 72 of each brace 12, 14. In the preferred embodiment, the pins 20, 22 have a length of about 2 inches from the outer surface 70, 72 to the distal end 82 of the pin 20, 22. The cross-section of the pin 20, 22 can be any regular shape, such as circular or square. In the preferred embodiment, the pin 20, 22 has a substantially round cross-section with a diameter of about ¾ inch. The upper surface 80 of the pin 20, 22 is smooth along its entire length; there are no abrupt changes in the surface contour. The outer surface of the pin 20, 22 is covered by a soft plastic or rubber material 88 in order to prevent wear of the pin 20, 22.

One end of the pin 20, 22 is attached to the outer surface 70, 72. The pin 20, 22 is attached at an angle that will keep the bar positioned on the upper surface of the pin 80, but that will also allow the individual to easily dump the bar with little effort by leaning forward slightly and pushing the bar forward. In the preferred embodiment, the angle is about 90° from the plane of the outer surface 70, 72 where the pin 20, 22 is attached. The pin 20, 22 can be attached to the outer surface 70, 72 by any permanent means, including welding, adhesive, by initially forming the brace 12, 14 to include the pin 20, 22, or by forming the pin 20, 22 and pin hole 62, 64 with mating threads. In the preferred embodiment, the pin 20, 22 is an additional ⅜ inch long and extends through the pin hole 62, 64 about 2 inches from the outer surface 70, 72 and about ⅛ inch from the inner surface 74, 76. The pin 20, 22 is welded to the inner surface 86. Preferably, the pin 20, 22 is composed of cold rolled steel.

The crossbar has two embodiments. In the first embodiment, the crossbar 30 is a ⅜-inch cold rolled steel plate about 4 inches long and 2 inches wide. There are three substantially circular through holes 32, 34, 44 through the crossbar 30. Two of the holes 32, 34 are located about ¾ inch below the top edge and approximately 1 ¼ inches on either side of the vertical center line. The third hole 44 is located about ¾ inch above the bottom edge and about on the vertical center line. The holes 32, 34, 44 are approximately ⅜ inch in diameter.

In the second embodiment, the crossbar 50 is a ⅜-inch cold rolled steel plate about 4 inches long and 2 inches wide. There are a pair of threaded studs 52, 54 projecting substantially perpendicularly from the inner surface 122 of the crossbar 50. The studs 52, 54 are located about on the horizontal center line and approximately 1 ¼ inches on either side of the vertical center line. The studs 52, 54 are threaded to accept a nut 56, 58 and are about ⅜ inch long. There is a substantially circular hole 60 located about ¾ inch above the bottom edge and about on the vertical center line. The hole 60 is approximately ⅜ inch in diameter.

The abdominal support 130 is a ⅜-inch cold rolled steel plate about 7 inches long and 4 inches wide. There is a slot 134 about ⅜ inch wide centered approximately on the vertical center line of the abdominal support 130 and extends from about ½ inch from the top edge to about ½ inch from the bottom edge.

Figure 12:
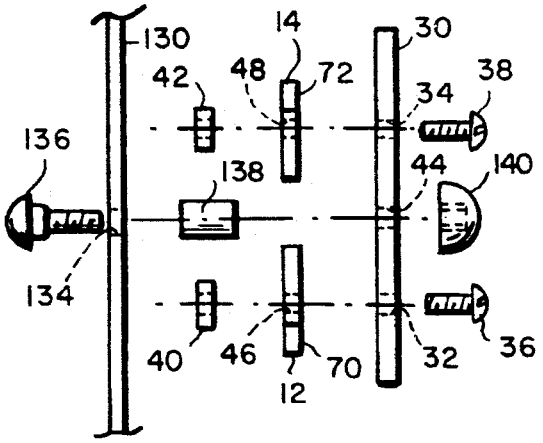
FIG. 12 is an exploded top view in partial cross-section of the fastening of the braces, first embodiment of the crossbar, and abdominal support.

FIG. 12 shows how the braces 12, 14, the first embodiment of the crossbar 30, and the abdominal support 130 are fastened together. One bolt 36 is inserted through the right crossbar hole 32 and into the right brace mounting hole 46 such that the outer surface 70 of the right brace 12 is in contact with the crossbar 30. A nut 40 is turned onto the bolt 36 to secure the right brace 12 to the crossbar 30. The other bolt 38 is inserted through the left crossbar hole 34 and into the left brace mounting hole 48 such that the outer surface 72 of the left brace 14 is in contact with the crossbar 30. A nut 42 is turned onto the bolt 38 to secure the left brace 14 to the crossbar 30. To attach the abdominal support 130, a carriage bolt 136 is inserted into the slot 134 in the abdominal support 130. A bushing 138 is inserted onto the carriage bolt 136. The purpose of the bushing 138 is to keep the abdominal support from rubbing on the nuts 40, 42 or ends of the bolts 36, 38. After the bushing 138, the carriage bolt 136 is inserted into the abdominal support hole 44 of the crossbar 30. Then a threaded knob 140 is turned onto the carriage bolt to secure the abdominal support 130 to the crossbar 30. The knob 140 permits the individual to easily adjust the position of the abdominal support.

Figure 13:
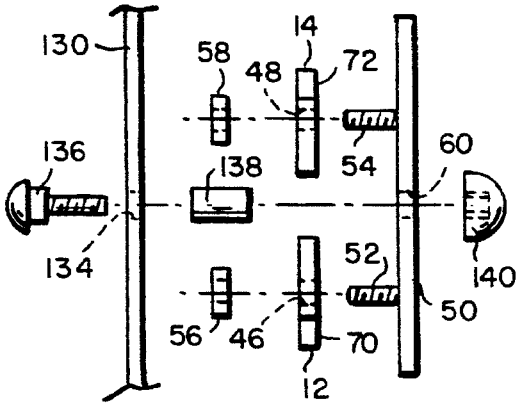
FIG. 13 is an exploded top view in partial cross-section of the fastening of the braces, second embodiment of the crossbar, and abdominal support.

FIG. 13 shows how the braces 12, 14, the second embodiment of the crossbar 50, and the abdominal support 130 are fastened together. One crossbar stud 52 is inserted into the right brace mounting hole 46 such that the outer surface 70 of the right brace 12 is in contact with the crossbar 50. A nut 56 is turned onto the stud 52 to secure the right brace 12 to the crossbar 50. The other crossbar stud 54 is inserted into the left brace mounting hole 48 such that the outer surface 72 of the left brace 14 is in contact with the crossbar 50. A nut 58 is turned onto the stud 54 to secure the left brace 14 to the crossbar 50. To attach the abdominal support 130, a carriage bolt 136 is inserted into the slot 134 in the abdominal support 130. A bushing 138 is inserted onto the carriage bolt 136. The purpose of the bushing 138 is to keep the abdominal support from rubbing on the nuts 56, 58 or ends of the studs 52, 54. After the bushing 138, the carriage bolt 136 is inserted into the abdominal support hole 60 of the crossbar 50. Then a threaded knob 140 is turned onto the carriage bolt to secure the abdominal support 130 to the crossbar 50. The knob 140 permits the individual to easily adjust the position of the abdominal support.

Figure 11:
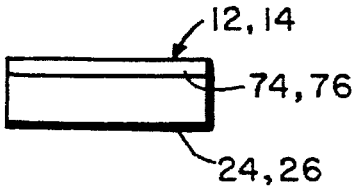
FIG. 11 is a cross-sectional view of the brace and cushion combination.

Along the length of the inner surface 74, 76 of the braces 12, 14 and the inner surface 142 of the abdominal support 130 are secured cushions 24, 26, 132. The cushions 24, 26, 132 are made of a resilient material that maintains the back, shoulders, chest, and abdomen in comfort while using the harness 10. As in FIG. 11, the brace cushion 24, 26 is about the same width as the brace 12, 14, and is about 1 inch thick. The brace cushion 24, 26 extends along substantially the entire inner surface 74, 76 of the brace 12, 14. The abdominal support cushion 132 is about the same length and width as the abdominal support 130 and is about 1 inch thick. Preferably, the cushions 24, 26, 132 are made of neoprene. A typical neoprene is Rubertex Corporation stock number G-207-N, which has the specifications listed in Table 1.

TABLE 1

| Parameter | Value |
|---|---|
| Polymer | Neoprene (CR) |
| Specification | |
| ASTM D-1056-67 | SCE-42-43 |
| ASTM D-1056-68 | SCE-42-43 |
| ASTM D-1056-85 | 2C2-3-E2 |
| Compression Deflection | 5–13 p.s.i. |
| Density, average | 15–30 p.c.f. |
| Water absorption by weight, maximum | 5% |
| Temperature range | |
| Low (flex without cracking) | −30° F. |
| High continuous | 150° F. |

TABLE 1-continued

| Parameter | Value |
|---|---|
| High intermittent | 200° F. |
| Heat aging lineal shrinkage, maximum (7 days, 158° F.) | 5% |

The cushions 24, 26, 132 are secured to the brace 12, 14 and abdominal support 130 by any method that will bond the two materials together permanently.

Figure 14:
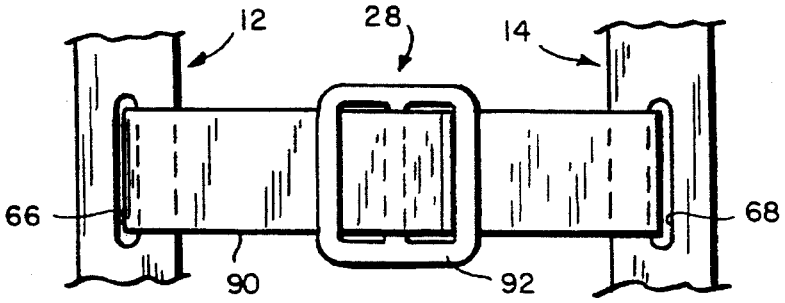
FIG. 14 is a front elevational view of the tie.
Figure 15:
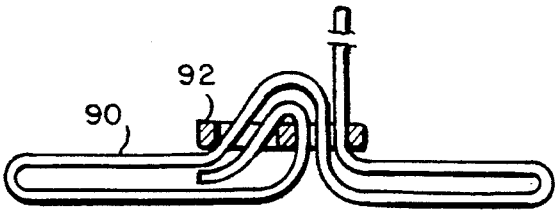
FIG. 15 is a profile view of the tie of FIG. 14.

FIGS. 14 and 15 show the tie 28. In the preferred embodiment, the tie 28 consists of a strap 90 that loops through the slots 66, 68 and a means to adjust the length of the strap 90. The strap 90 is preferably composed of nylon and is about 1 inch wide. The means to adjust the length of the strap 90 is a friction device where the strap 90 is looped through a substantially square buckle 92 with a center partition. The strap 90 is looped through the buckle 92 in such a way that when there is a pulling tension on the strap 90 from where it loops through the tie slots 66, 68, the tie 28 will not lengthen, but when there is no tension, the strap 90 can easily be moved through the buckle 92 to adjust the length of the tie 28.

FIGS. 16 TO 18—OPERATION

Figure 16:
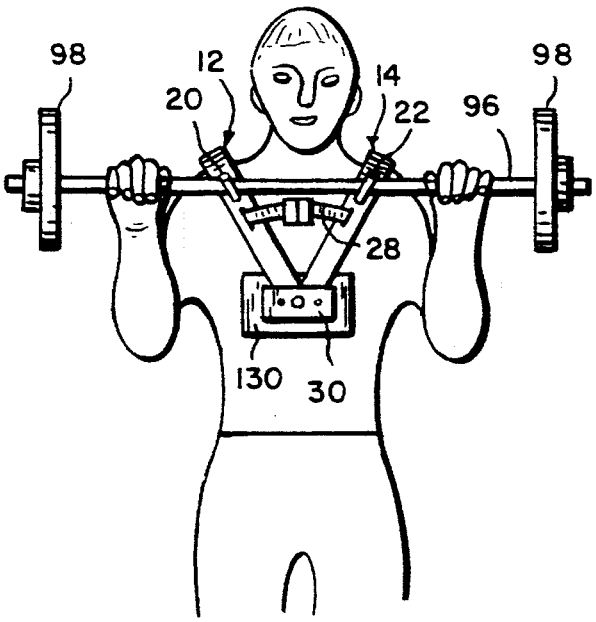
FIG. 16 shows one view of the present invention in use.
Figure 17:
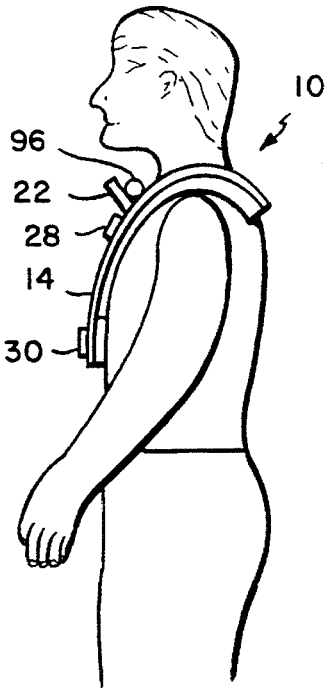
FIG. 17 shows another view of the present invention in use.

FIGS. 16 and 17 show the athletic harness of the present invention in use. The harness 10 is first placed on the shoulders such that the cushion 132 of the abdominal support 130 is against the individual's abdominal area. The length of the tie 28 and the vertical position of the abdominal support 130 are adjusted to the individual. The bar 96, previously loaded with weight plates 98, is placed on the pins 20, 22 such that the bar 96 rests between the pins 20, 22 and the outer surface 70, 72 of the braces 12, 14. The individual then commences the front squat exercise. If for any reason the individual wishes to dump the bar 96, he or she merely leans forward slightly and pushes the bar 96 forward off the pins 20, 22 by hand.

Figure 18:
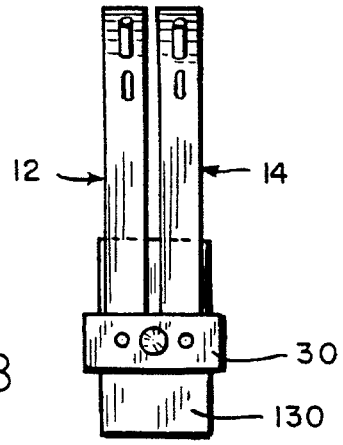
FIG. 18 shows a front view of the present invention in its storage and shipping configuration.

For storage and shipping, the harness 10 is folded up by rotating the right brace 12 and left brace 14 together and by rotating the abdominal support 130 by 90°, as in FIG. 18.

What is claimed is:

1. An athletic harness for enhancing thoracic freedom while supporting a barbell during front squat exercises, said harness comprising:

(a) a pair of rigid, over-the-shoulder, inverted "J"-shaped braces for maintaining the dimensional stability of said harness during said front squat exercises;

(b) said braces including extended anterior portions that engage the chest, posterior portions that engage the shoulders rearwardly, and yoke portions that engage the shoulders supportively;

(c) a connection means for connecting the lower extremities of said anterior portions together;

(d) a pair of pins projecting forwardly from said anterior portions;

(e) said pins being adapted to carry the bar of said barbell during said front squat exercises; and (f) an antisplaying means for preventing splaying of said braces during said front squat exercises.

2. The athletic harness of claim 1 wherein said connection means includes a crossbar.

3. The athletic harness of claim 2 wherein said crossbar connects said braces by a means that permits said braces to rotate relative to each other about their points of connection in order to facilitate transportation, storage, and adjustment for different sized individuals.

4. The athletic harness of claim 2 wherein an abdominal support is attached to the rear of said crossbar.

5. The athletic harness of claim 4 wherein said abdominal support is slidably and rotatably attached to the rear of said crossbar in order to facilitate transportation, storage, and adjustment for different sized individuals.

6. The athletic harness of claim 4 wherein a resilient cushion is attached to the inner surface of said abdominal support, said cushion maintaining the comfort of said abdomen during said front squat exercises.

7. The athletic harness of claim 6 wherein said resilient cushion is composed of neoprene.

8. The athletic harness of claim 4 wherein said braces, pins, crossbar, and abdominal support are composed of cold rolled steel.

9. The athletic harness of claim 1 wherein said pins are mounted to said anterior portions to allow the dumping of said bar by leaning forward, and wherein said pins have a smooth surface and no impediments to dumping said bar.

10. The athletic harness of claim 1 wherein a resilient cushion is attached to the inner surface of each of said braces, said cushions maintaining the comfort of said shoulders and chest during said front squat exercises.

11. The athletic harness of claim 10 wherein said cushions extend along substantially the entire length of said inner surfaces.

12. The athletic harness of claim 10 wherein said resilient cushions are composed of neoprene.

13. The athletic harness of claim 1 wherein said antisplaying means includes a tie fastened between said anterior portions at slots located in said anterior portions.

14. The athletic harness of claim 13 wherein the length of said tie is adjustable.

15. The athletic harness of claim 1 wherein said antisplaying means includes a tie fastened between said posterior portions at slots located in said posterior portions.

16. The athletic harness of claim 15 wherein the length of said tie is adjustable.

17. An athletic harness for enhancing thoracic freedom while supporting a barbell during front squat exercises, said harness comprising:

(a) a pair of rigid, over-the-shoulder, inverted "J"-shaped braces for maintaining the dimensional stability of said harness during said front squat exercises;

(b) said braces including extended anterior portions that engage the chest, posterior portions that engage the shoulders rearwardly, and yoke portions that engage the shoulders supportively;

(c) a crossbar that connects the lower extremities of said anterior portions by a means that permits said braces to rotate relative to each other about their points of connection in order to facilitate transportation, storage, and adjustment for different sized individuals;

(d) an abdominal support that engages the abdomen and attaches to the rear of said crossbar by a means that permits said abdominal support to rotate and slide relative to said crossbar in order to facilitate transportation, storage, and adjustment for different sized individuals;

(e) a pair of pins projecting forwardly from said anterior portions;

(f) said pins being adapted to carry the bar of said barbell during said front squat exercises;

(g) said pins being mounted to said anterior portions to allow the dumping of said bar by leaning forward;

(h) said pins having a smooth surface and no impediments to dumping said bar;

(i) an extended inner resilient cushion attached to the inner surface of each of said braces for maintaining the comfort of said shoulders and chest during said front squat exercises;

(j) a resilient cushion attached to the inner surface of said abdominal support for maintaining the comfort of said abdomen during said front squat exercises;

(k) a tie fastened to said anterior portions for preventing splaying of said braces during said front squat exercises;

(l) said tie being fastened to said anterior portions at slots located in said anterior portions;

(m) the length of said tie being adjustable;

(n) said braces, pins, and crossbar being composed of cold rolled steel; and (o) said cushions being composed of neoprene.

18. An athletic harness for enhancing thoracic freedom while supporting a barbell during front squat exercises, said harness comprising:

(a) a pair of rigid, over-the-shoulder, inverted "J"-shaped braces for maintaining the dimensional stability of said harness during said front squat exercises, one of said braces being a right brace and the other of said braces being a left brace;

(b) said right and left braces including extended anterior portions that engage the chest, posterior portions that engage the shoulders rearwardly, and yoke portions that engage the shoulders supportively;

(c) said braces being about 2 inches wide;

(d) said right and left braces having a through mounting hole located substantially near the lower end of said anterior portion, a through pin hole of diameter about ¾ inch located in said anterior portion, and a tie slot located in said anterior portion below said pin hole;

(e) a crossbar having a right through mounting hole and a left through mounting hole approximately ¾ inch from the upper edge of said crossbar, and having a center through mounting hole approximately ¾ inch from the lower edge of said crossbar;

(f) an abdominal support that engages the abdomen, said abdominal support being about 7 inches long and 4 inches high;

(g) said abdominal support having a through slot extending from about ½ inch below the upper edge to about ½ inch above the lower edge of said abdominal support, said slot being about ⅜ inch wide and centered about the vertical center line of said abdominal support;

(h) a first bolt extending through said right crossbar mounting hole and said right brace mounting hole and secured by a first nut;

(i) a second bolt extending through said left crossbar mounting hole and said left brace mounting hole and secured by a second nut;

(j) a carriage bolt extending through said abdominal support slot, a bushing, said crossbar center mounting hole, and secured by a knob having a threaded hole;

(k) a pair of pins having a length of about 1 ½ inches, a substantially circular cross-section of diameter about ¾ inch, and a smooth surface with no impediments to dumping said bar;

(l) said pins extending through said pin holes and projecting about 2 inches from the outer surface of said anterior portions and about ⅛ inch from the inner surface of said anterior portions;

(m) said pins being welded to said anterior portion inner surfaces;

(n) a resilient brace cushion attached to the inner surface of each of said braces and extending along substantially the entire length of said inner surfaces;

(o) said brace cushion having a width substantially the same as the width of said brace and a thickness of about 1 inch;

(p) a resilient crossbar cushion attached to the inner surface of said abdominal support for maintaining the comfort of the abdomen during said front squat exercises;

(q) said abdominal support cushion having a thickness of about 1 inch;

(r) said cushions being composed of neoprene;

(s) a tie fastened to said anterior portions for preventing splaying of said braces during said front squat exercises;

(t) said tie being fastened to said anterior portions at slots located in said anterior portions below said pin holes;

(u) said tie having an adjustable length;

(v) said tie being composed of nylon; and (w) said braces, pins, crossbar, and abdominal support being composed of cold rolled steel.

* * * * *